US005761157A

United States Patent [19]

Takeda et al.

[11] Patent Number: 5,761,157

[45] Date of Patent: *Jun. 2, 1998

[54] ENGAGEMENT STRUCTURE DISENGAGED BY RELATIVELY ROTATING PROJECTED BODY AND RECESSED BODY

[75] Inventors: Goro Takeda, 46, Kurusu, Kasagi-cho, Souraku-gun, Kyoto; Takashi Ueda, Osaka, both of Japan

[73] Assignee: Goro Takeda, Osaka, Japan

[ * ] Notice: The terminal 5 months of this patent has been disclaimed.

[21] Appl. No.: 394,413

[22] Filed: Feb. 24, 1995

[30] Foreign Application Priority Data

Feb. 25, 1994 [JP] Japan ..... 6-027830

[51] Int. Cl.[6] ..... G04B 37/00

[52] U.S. Cl. ..... 368/10; 368/316; 368/317

[58] Field of Search ..... 368/10, 278, 316, 368/317, 107–113; 224/30 R, 30 A, 32, 38, 36, 41

[56] References Cited

U.S. PATENT DOCUMENTS

| | | | |
|---|---|---|---|
| 2,576,476 | 11/1951 | Peter et al. | 368/278 |
| 3,241,308 | 3/1966 | Forney | 368/278 |
| 4,656,564 | 4/1987 | Felder . | |
| 4,742,500 | 5/1988 | Luce | 368/10 |
| 4,756,454 | 7/1988 | Villanueva et al. . | |
| 4,819,217 | 4/1989 | Houlihan | 368/10 |
| 4,887,249 | 12/1989 | Thinesen . | |
| 5,201,431 | 4/1993 | Berger et al. | 368/278 |

FOREIGN PATENT DOCUMENTS

| | | |
|---|---|---|
| 2 662 662 | 11/1991 | France . |
| 117928 | of 0000 | Taiwan . |
| PCT/US92/09532 | 5/1992 | WIPO . |

OTHER PUBLICATIONS

Partial English Translation of Official Action from the Taiwanese Patent Office.

*Primary Examiner*—Bernard Roskoski
*Attorney, Agent, or Firm*—Olson & Hierl, Ltd.

[57] ABSTRACT

A wrist watch to which an engagement structure of the present invention is applied includes a recessed body connected to a band, and a watch having a projected body formed on the rear side of a display portion. The projected body has an outer perimeter wall portion capable of fitting in an inner perimeter wall portion of the recessed body. The inner perimeter wall portion has a wall surface formed by joining circles with their centers at a second reference axis and with their diameters larger as the centers are shifted to the side of the watch portion. The outer perimeter wall portion has a wall surface formed by joining circles with their centers at a first reference axis and with their diameters smaller as the centers are shifted to the side of the recessed body. A recessed portion provided at the outer perimeter wall portion is engaged with a projected portion provided at the inner perimeter wall portion, and the watch and the recessed body are disengaged by relative rotation around the reference axis.

8 Claims, 13 Drawing Sheets

ENGAGEMENT STRUCTURE DISENGAGED BY RELATIVELY ROTATING PROJECTED BODY AND RECESSED BODY

BACKGROUND OF THE INVENTION

1. Field of the Invention

The present invention relates to engagement structures, and more particularly, to an engagement structure capable of engaging and disengaging a watch portion and a member including a band of a wrist watch.

2. Description of the Background Art

In recent years, a speedometer is often mounted to a bicycle in order to readily know a speed, a mileage or the like of the bicycle. Because of development of the semiconductor industry, the speedometer also has a clock function. The meter portion is often detached to be used as a clock or a wrist watch. An example where a wrist watch is used as a speedometer is triathlon. In the triathlon, a wrist watch is used as a speedometer in cycling, and used as a wrist watch in swimming and running.

FIG. 17 is a diagram showing a wrist watch which can serve also as such a speedometer disclosed in U.S. Pat. No. 4,819,217.

Referring to FIG. 17, a wrist watch 1 includes a watch portion 5 formed of a case 13 provided with a display portion 3, a band 7*a* rotatably attached to one end side of case 13, and a band 7*b* rotatably attached to the other end side of case 13. Case 13 is provided with a recess 9 having a connecting terminal, not shown, and switches 11*a*, 11*d*, 11*e* on its side surfaces. Switches 11*b* ad 11*c* are provided to case 13 between display portion 3 and band 7*b*.

Case 13 is formed of a material such as plastic. Case 13 is formed integrally with rubber bands 7*a* and 7*b* in an inseparable state.

FIG. 18 is a side view showing a state where a speedometer including the wrist watch shown in FIG. 17 is attached to a bicycle. FIG. 19 is an enlarged perspective view of a "X" portion of FIG. 18, and FIG. 20 is an enlarged view of a "Y" portion of FIG. 18.

Referring to FIGS. 18 to 20, a speedometer 19 is attached to handlebars 17 of a bicycle 15. Speedometer 19 is configured of wrist watch 1 fixed to a bracket 21 attached to handlebars 17 as shown in FIG. 19. A magnet 25 is attached to a front spoke 23 of bicycle 15. Attached to a portion of a fork 27 corresponding to magnet 25 is a sensor portion 29 generating one signal every time magnet 25 traverses the front of the sensor portion.

The signals generated by sensor portion 29 are input to speedometer 19 through a cord 31. Various calculations are carried out based on the signals, and information such as a speed, a mileage or the like is provided to the user.

FIG. 21 is a perspective view showing a state where the bracket is detached from the handlebars and the watch. This figure is given for explanation of a state where the watch is attached to the bracket.

Referring to FIG. 21, bracket 21 includes a first supporting member 33 of a semicylindrical shape, a second supporting member 36 having a side surface shaped in a U letter, and a third supporting member 35 having a handlebar attachment portion 38 attached to the handlebars together with first supporting member 33 and a watch attachment portion 50 receiving a wrist watch together with second supporting member 36.

One end portion 39*a* of first supporting member 33 is rotatably engaged with one end portion 41*a* of handlebar attachment portion 38 by a pin 37. The other end portion 39*b* of first supporting member 33 can be engaged with the other end portion 41*b* of handlebar attachment portion 38 by a pin inserted into a pin hole 43 formed at the other end portion 39*b* of first supporting member 33. When the other end portion 39*b* of first supporting member 33 is engaged with the other end portion 41*b* of handlebar attachment portion 38 as described above, an inner surface 47 of first supporting member 33 and an inner surface 45 of handlebar attachment portion 38 are shaped along the handlebars, not shown.

Third supporting member 35 is connected to cord 31. Watch attachment portion 50 is provided with connecting terminals 55*a* and 55*b*. Watch attachment portion 50 includes an attachment wall portion 51 provided with connecting terminals 55*a* and 55*b*, an attachment bottom portion 49 in contact with a rear surface of wrist watch 1 opposing to display portion 3 shown in FIG. 17, and attachment projections 53*a* and 53*b* provided opposing to attachment wall portion 51 with an interval of the length of case 13 of wrist watch 1 in the width direction of the band. A recess 57 is formed between attachment projections 53*a* and 53*b* which can engage with the projection of second supporting member 36, to be described later.

Second supporting member 36 includes an opening 65 of a rectangular shape through which display portion 3 of wrist watch 1 is visually identified externally, a wall portion 59*a* rotatably fixed to third supporting member 35 by a pin 63, and a wall portion 59*b* opposing wall portion 59*a* and having a projection capable of engaging with recess 57 of second supporting member 35.

In such bracket 21, after disengaging the end portion of band 7*a* and the end portion of band 7*b* of wrist watch 1 shown in FIG. 17, wrist watch 1 is attached so that the rear surface of case 13 comes in contact with attachment bottom portion 49 of watch attachment portion 50. At this time, connecting terminals provided in recess 9 of wrist watch 1 and connecting terminals 55*a* and 55*b* provided in attachment wall portion 51 of watch attachment portion 50 are brought into contact with each other and rendered electrically conductive, so that a speed and a mileage can be displayed. Further, case 13 of wrist watch 1 is completely fixed to bracket 21 by attachment wall portion 51 of watch attachment portion 50, attachment projections 53*a* and 53*b*, and second supporting member 36.

When wrist watch 1 shown in FIG. 17 is attached to bracket 21 shown in FIG. 21, case 13 is sandwiched by watch attachment portion 50 in third supporting member 35 and second supporting member 36, and completely fixed. Therefore, bands 7*a* and 7*b* do not contribute to engagement in speedometer 19 shown in FIG. 19. In order to use wrist watch 1 as a speedometer, the user using wrist watch 1 including bands 7*a* and 7*b*, which appear to be unnecessary, must first disengage the end portions of bands 7*a* and 7*b* attached to the arm.

However, disengaging the end portions of the bands which do not contribute to engagement every time is cumbersome. Further, it is difficult for the user on the bicycle who wears wrist watch 1 on the arm to detach wrist watch 1 and to attach the same to bracket 21 with one hand. It is also difficult for the user to detach wrist watch 1 from bracket 21 to use the same as a wrist watch.

SUMMARY OF THE INVENTION

One object of the present invention is to implement reliable engagement and simple disengagement in an engagement structure.

Another object of the present invention is to simply disengage engaged parts by relative rotation of the engaged parts in an engagement structure.

Still another object of the present invention is to naturally disengage engaged parts by relative rotation of the engaged parts.

In order to achieve the above objects, the engagement structure according to the present invention formed of a projected body including a first reference axis and a recessed body including a second reference axis, in which the projected body and the recessed body are engaged with each other with the first reference axis and the second reference axis aligned as a rotation axis, and disengaged by relatively rotating around the rotation axis, wherein the projected body includes: an outer perimeter wall portion using as an outer surface at least a part of a surface formed by joining the circumferences of circles with their centers at the first reference axis and with their diameters orthogonal to the first reference axis and decreasing continuously as change of their center positions on the first reference axis; and a recessed portion or projected portion formed at the outer perimeter wall portion, and the recessed body includes: an inner perimeter wall portion using as an inner surface at least a part of a surface formed by joining the circumferences of circles with their centers at the second reference axis and with their diameters orthogonal to the second reference axis and decreasing continuously as change of their center positions on the second reference axis, and having a shape capable of rotatably fitting in the outer perimeter wall portion around the rotation axis; and a projected portion or recessed portion formed at the inner perimeter wall portion and capable of engaging with the recessed portion or projected portion of the outer perimeter wall portion.

In the engagement structure as described above, a recessed or projected portion formed at the outer perimeter wall portion is engaged with a recessed or projected portion formed at the inner perimeter wall portion. Therefore, reliable engagement and simple disengagement can be implemented.

The foregoing and other objects, features, aspects and advantages of the present invention will become more apparent from the following detailed description of the present invention when taken in conjunction with the accompanying drawings.

DESCRIPTION OF THE PREFERRED EMBODIMENTS

Figure 1:
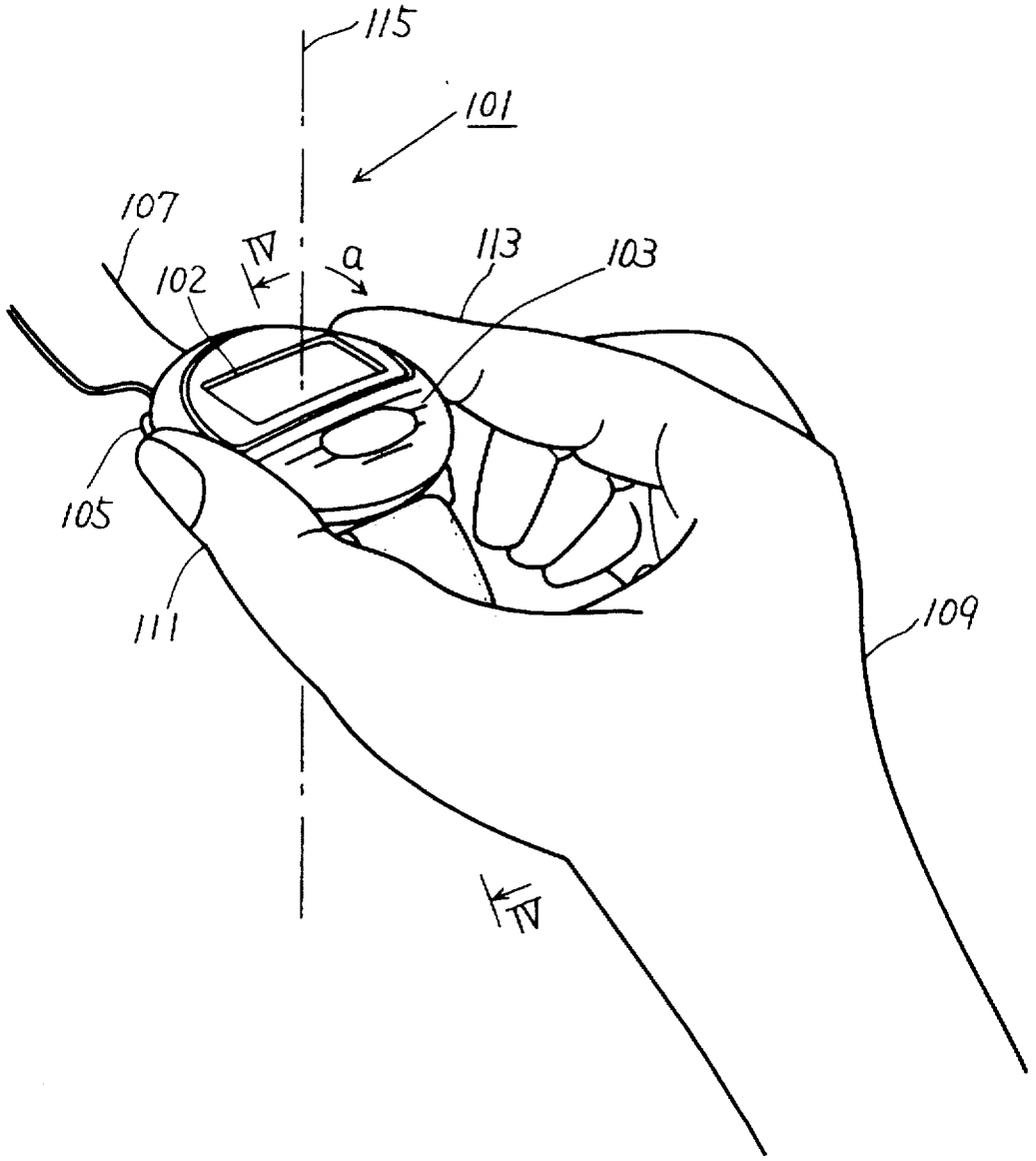
FIG. 1 is a diagram showing a state where a watch portion is being detached from a wrist watch using an engagement structure according to one embodiment of the present invention.
Figure 2:
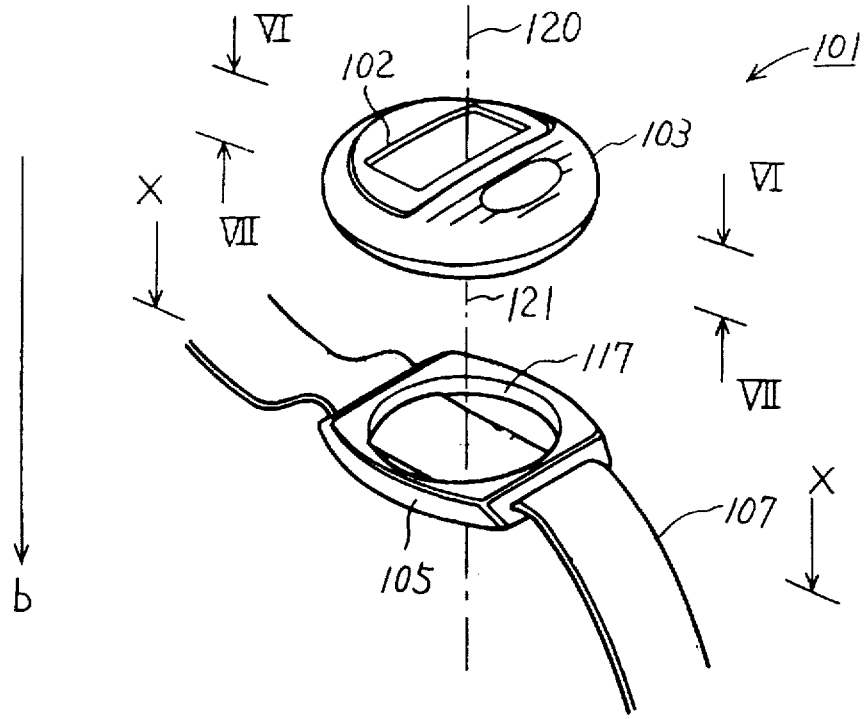
FIG. 2 is an exploded perspective view showing a state where a portion including a band and a recessed body is detached from the watch portion in the wrist watch of FIG. 1.
Figure 3:
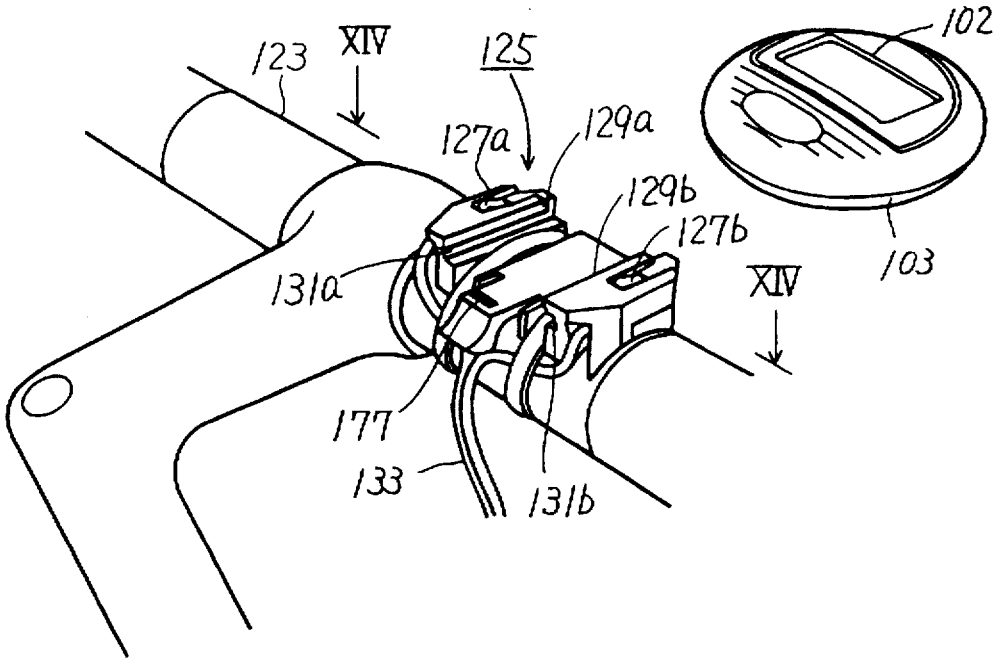
FIG. 3 is a diagram showing a state before the watch portion of FIG. 2 is attached to a bracket attached to the handlebars of a bicycle.
Figure 4:
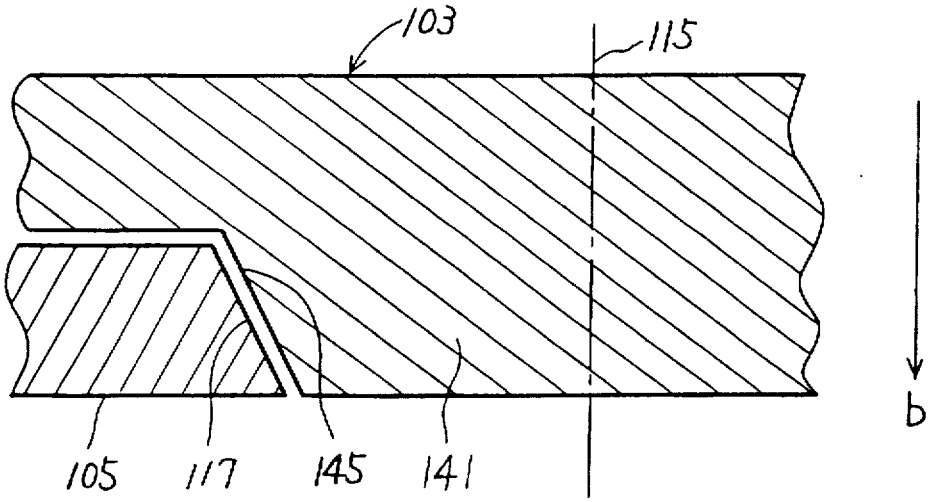
FIG. 4 is an enlarged partial sectional view taken along the line IV—IV of FIG. 1.
Figure 5:
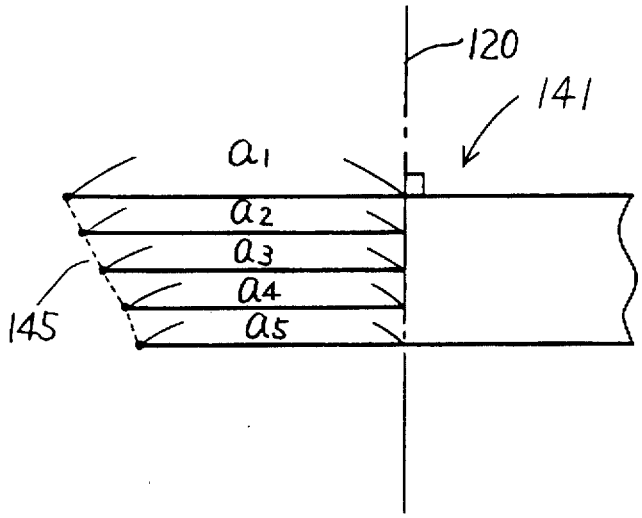
FIG. 5 is a diagram for explaining more specifically the state shown in FIG. 4.

FIG. 1 is a diagram showing a state where the watch portion is being detached from the wrist watch using the engagement structure according to one embodiment of the present invention. FIG. 2 is an exploded perspective view of a state where the watch portion is detached in the engagement structure of FIG. 1. FIG. 3 is a diagram showing a state before the detached watch portion is attached to the bracket. FIG. 4 is an enlarged partial sectional view taken along the line IV—IV of FIG. 1. FIG. 5 is a diagram for explaining more specifically the state shown in FIG. 4.

Referring to FIGS. 1 to 5, the wrist watch using the engagement structure according to one embodiment of the present invention will be described briefly.

A wrist watch 101 includes a display portion 102, a watch portion 103 having a projected body on a rear side opposing display portion 102, a recessed body 105 engaged with or disengaged from the projected body, and a band 107. With recessed body 105 and watch portion 103 engaged with each other as shown in FIG. 1, by rotating watch portion 103 in the direction of an arrow a by a thumb 111 and an index finger 113 of a hand 109, for example, to relatively rotate watch portion 103 with respect to recessed body 105 around a rotation axis 115, watch portion 103 is detached from recessed body 105 as shown in FIG. 2.

An inner perimeter wall portion 117 of recessed body 105 shown in FIGS. 2 and 4 is shaped along an outer perimeter wall portion 145 of a projected body 141 provided on one side of watch portion 103. Inner perimeter wall portion 117 of recessed body 105 and outer perimeter wall portion 145 of projected body 141 each have a wall surface formed by joining circles with their centers at rotation axis 115 and with their diameters orthogonal to rotation axis 115 and smaller in the direction of an arrow b. More specifically, as shown in FIG. 5, when engaged, outer perimeter wall portion 145 of projected body 141, for example, has a shape formed by joining circles with their centers at first reference axis 120 which is also serving as rotation axis 115 and with their radii (in other words, diameters) $a_1$, $a_2$, $a_3$, $a_4$ and $a_5$ different in length, wherein $a_1>a_2>a_3>a_4>a_5$. Similarly, when engaged, inner perimeter wall portion 117 of recessed body 105 fitting in outer perimeter wall portion 145 of projected body 141 has a shape formed by joining circles with their centers at second reference axis 121 which is also serving as rotation axis 115 and with their radii (in other words, diameters) respectively corresponding to $a_1$, $a_2$, $a_3$, $a_4$ and $a_5$ different in length.

Using such first reference axis 120 and second reference axis 121 as rotation axis 115, watch portion 103 relatively rotated to be detached from recessed body 105 is attached to bracket 125 attached to handlebars 123 of a bicycle. Slide projected portions 129*a* and 129*b* provided to bracket 125 are fitted in corresponding slide recessed portions of watch portion 103, slide recessed portions 131*a* and 131*b* provided to bracket 125 are fitted in corresponding slide projected portions of watch portion 103, and a projection 177 provided to bracket 125 is engaged with a corresponding recess of watch portion 103. Watch portion 103 is thus attached to bracket 125.

Then, signals through a cord 133 are input to watch portion 103 through connecting terminals of watch portion 103, not shown, connecting to connecting terminals 127*a* and 127*b* and calculated, whereby a speed, a mileage or the like are displayed in display portion 102.

Figure 6:
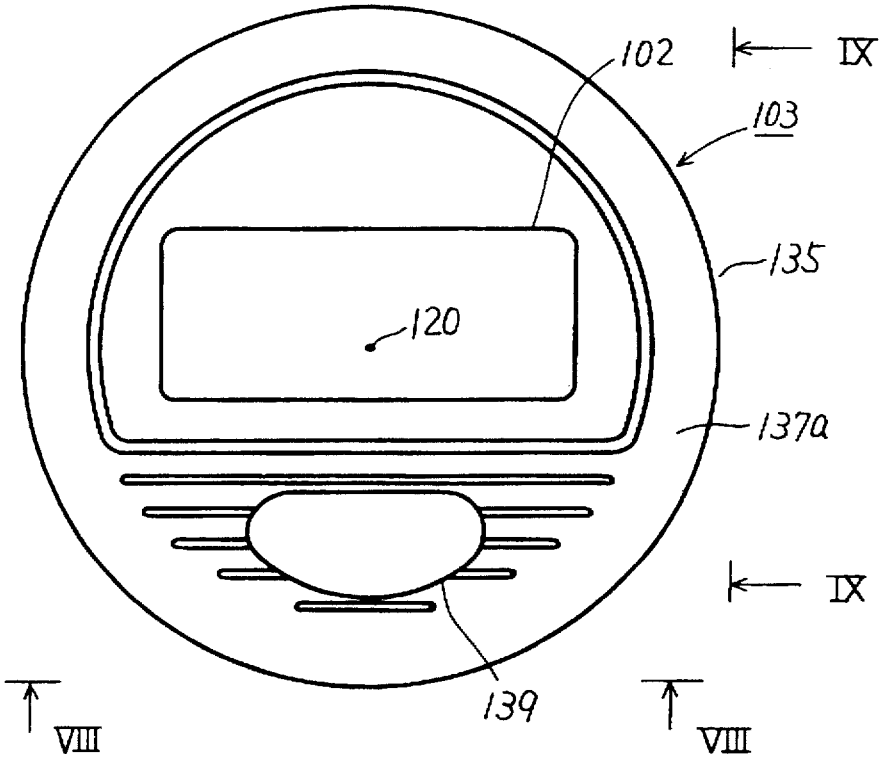
FIG. 6 is a diagram seen from the line VI—VI of FIG. 2.
Figure 7:
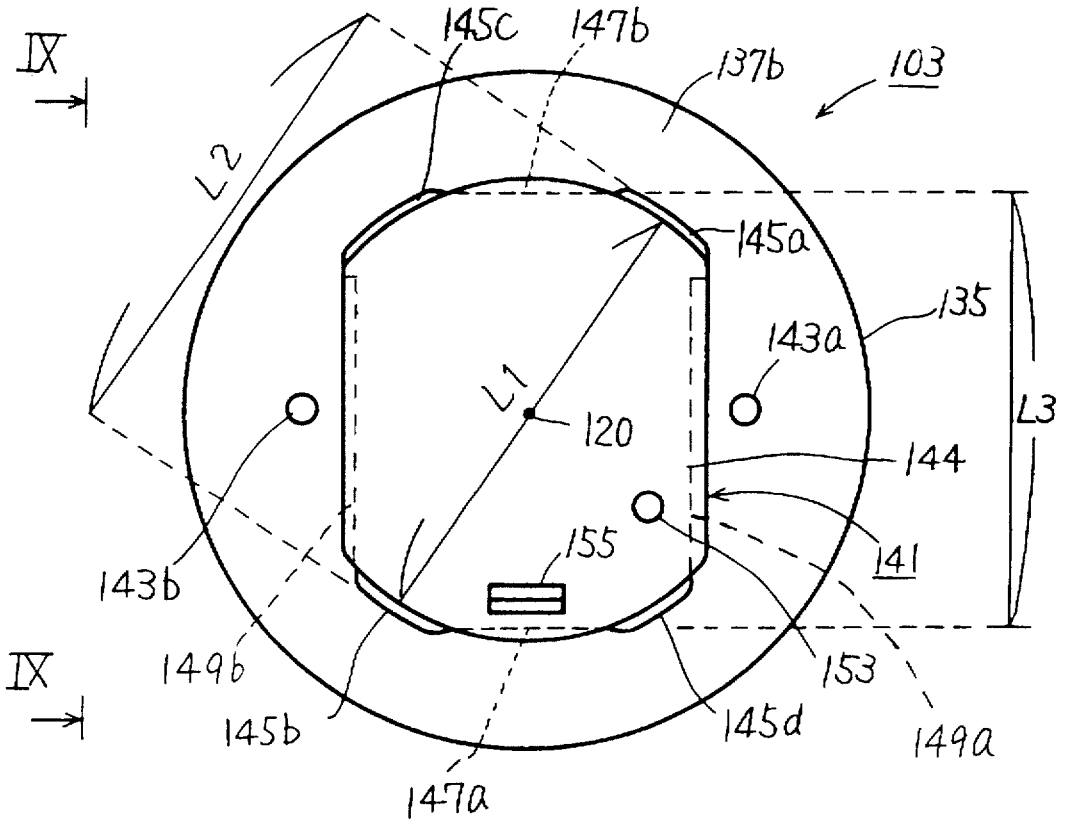
FIG. 7 is a diagram seen from the line VII—VII of FIG. 2.
Figure 8:
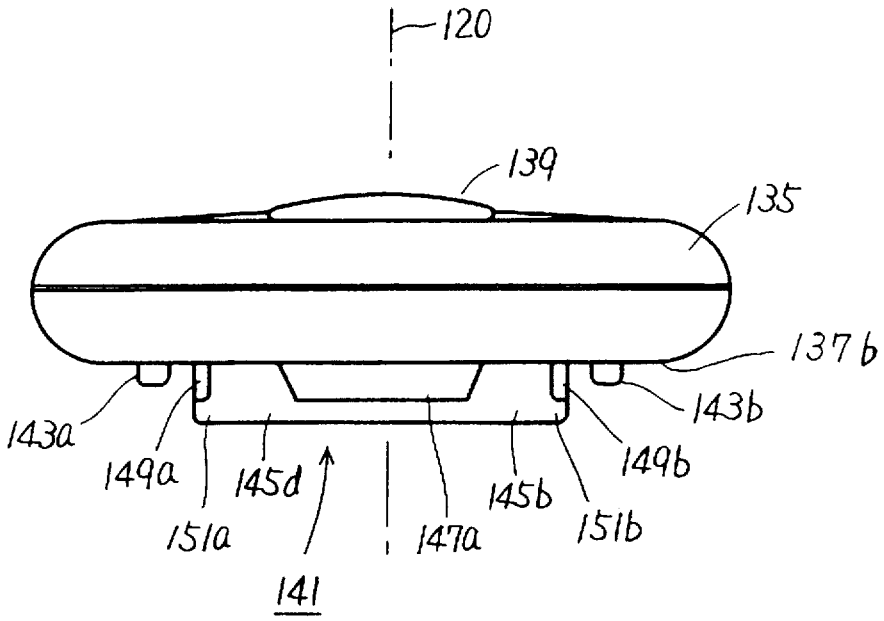
FIG. 8 is a diagram seen from the line VIII—VIII of FIG. 6.
Figure 9:
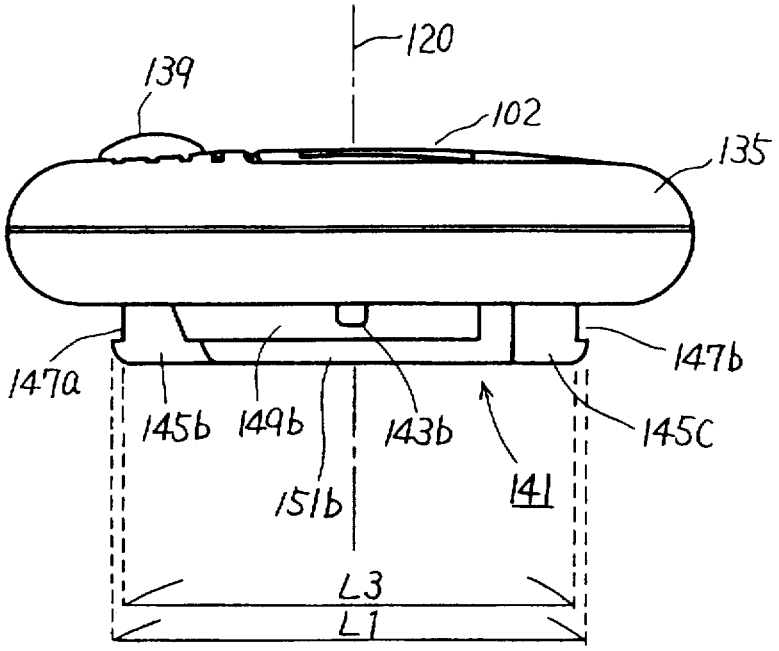
FIG. 9 is a diagram seen from the line IX—IX of FIGS. 6 and 7.

FIG. 6 is a diagram seen from the line VI—VI of FIG. 2, FIG. 7 is diagram seen from the line VII—VII of FIG. 2, FIG. 8 is a diagram seen from the line VIII—VIII of FIG. 6, and FIG. 9 is a diagram seen from the line IX—IX of FIGS. 6 and 7.

Referring to FIGS. 6 to 9, the structure of the watch portion will be described in detail. Watch portion 103 has a display function portion of a disc shape. Display function portion 135 performs an operation for displaying a speed, a mileage or the like in display portion 102 formed on one side 137*a* thereof. Further, a switch button 139 for performing the operation is provided at a lower portion of display portion 102 on one side 137*a*.

Projected body 141 of a column shape is formed around first reference axis 120 on the other side 137*b* of display function portion 135. Projected body 141 has outer perimeter wall portions 145*a*, 145*b*, 145*c* and 145*d* similar to part of a side face of a truncated cone. Outer perimeter wall portion 145*a* and outer perimeter wall portion 145*b* are positioned opposing to each other around first reference axis 120, and outer perimeter wall portion 145*c* and outer perimeter wall portion 145*d* are positioned opposing to each other around first reference axis 120.

The distance between outer perimeter wall portion 145*a* and outer perimeter wall portion 145*b* is L2 along the other side 137*b* of display function portion 135, and L1 along an end surface 144 of the projected body. The length L2 is larger than the length L1. There is a similar relation between outer perimeter wall portion 145*c* and outer perimeter wall portion 145*d*.

More specifically, outer perimeter wall portions 145*a*, 145*b*, 145*c* and 145*d* are respectively formed as follows. Outer perimeter wall portion 145*a*, for example, has a wall surface formed by joining parts of the circumferences of circles with their radii orthogonal to first reference axis 120 decreasing as their centers move to the side of end surface 144 along first reference axis 120. Outer perimeter wall portions 145*a*–145*d* formed as described above have a shape which can fit in the inner perimeter wall portion of recessed body 105, to be described in detail later.

Further, projected body 141 has following portions other than outer perimeter wall portions 145*a*, 145*b*, 145*c* and 145*d* formed on its side face. A recessed portion 147*b* is formed between outer perimeter wall portion 145*a* and outer perimeter wall portion 145*c*, and a recessed portion 147*a* is formed between outer perimeter wall portion 145*b* and outer perimeter wall portion 145*d*. The length between recessed portions 147*a* and 147*b* is L3. Therefore, the relation of the length of L3<L1<L2 holds. Between outer perimeter wall portion 145*c* and outer perimeter wall portion 145*b*, formed are a slide recessed portion 149*b* fitting in a slide projected portion 129*b* of bracket 125 shown in FIG. 3 and a slide projected portion 151*b* fitting in a slide recessed portion 131*b* of bracket 125. Similarly, between outer perimeter wall portion 145*a* and outer perimeter wall portion 145*d*, formed are a slide recessed portion 149*a* fitting in a slide projected portion 129*a* of bracket 125 shown in FIG. 3 and a slide projected portion 151*a* fitting in a slide recessed portion 131*a* of bracket 125.

An All-Clear (AC) button 153 is provided on end surface 144 of projected body 141. A recess 155 is formed on end surface 144 and on outer perimeter wall portion 145*b* and outer perimeter wall portion 145*d* sides.

Other than such projected body 141, connecting terminals 143*a* and 143*b* which can connect to connecting terminals 127*a* and 127*b* of the bracket shown in FIG. 3 are formed on the other side 137*b* of display function portion 135.

Watch portion 103 having such projected body 141 or the like is fixed by recessed body 105. Therefore, description will now be given of recessed body 105. Further, description will be given of the engagement of recessed body 105 with watch portion 103 and disengagement of recessed body 105 from watch portion 103.

Figure 10:
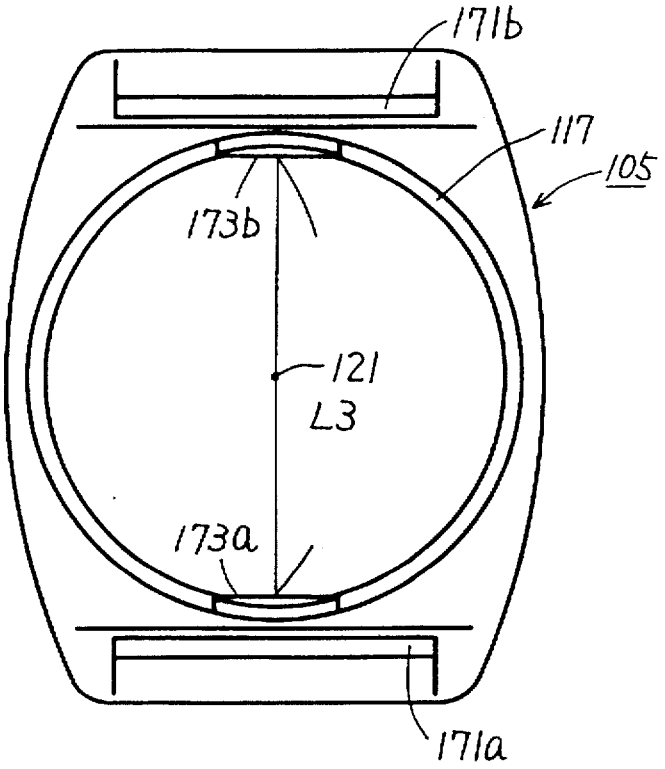
FIG. 10 is a diagram of a recessed body detached from the band of FIG. 2 seen from the line X—X.
Figure 11:
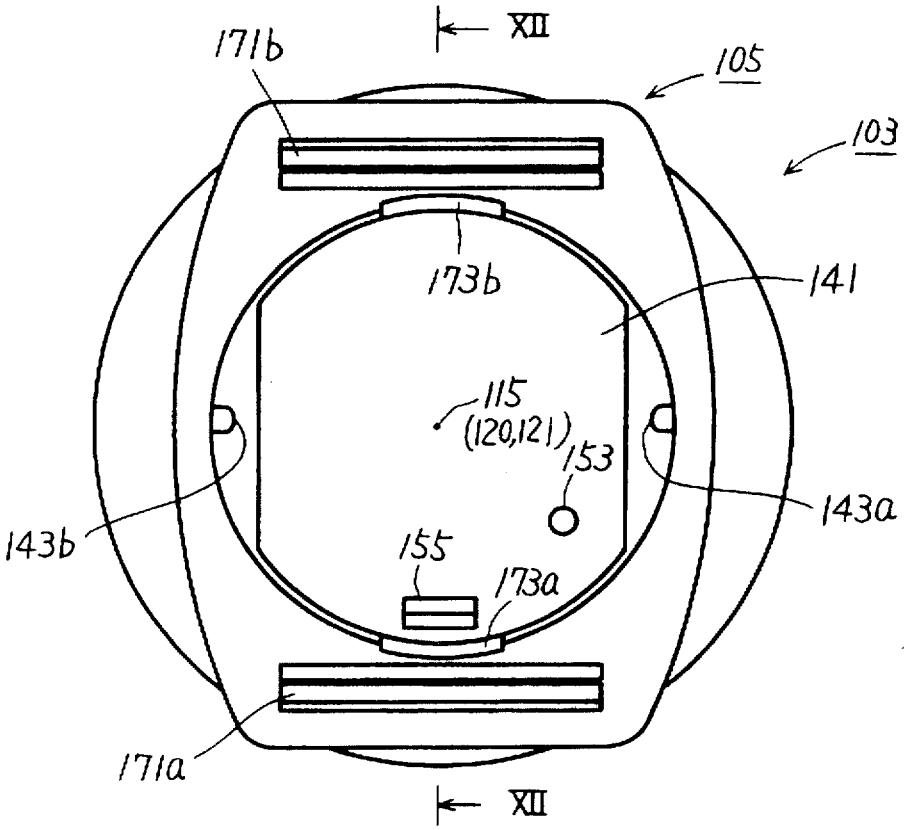
FIG. 11 is a diagram of a state where the watch portion is attached to the recessed body shown in FIG. 10 seen from the rear side.
Figure 12:
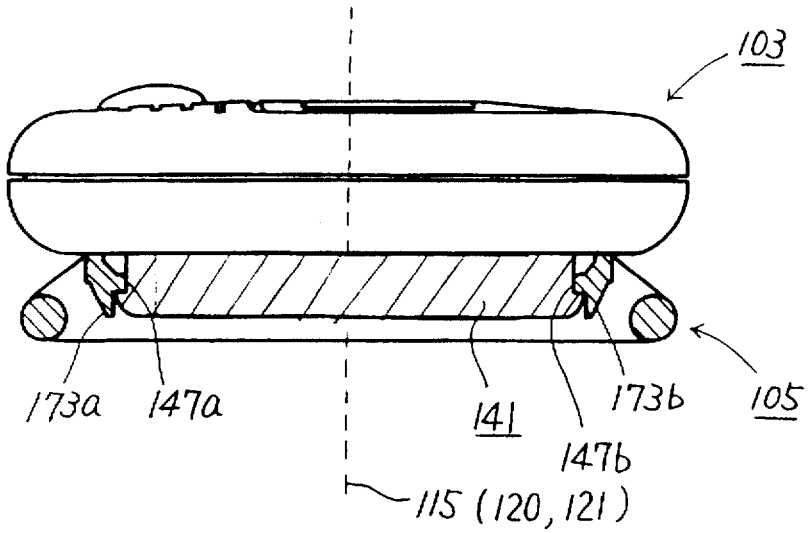
FIG. 12 is a partial sectional view taken along the line XII—XII of FIG. 11.
Figure 13:
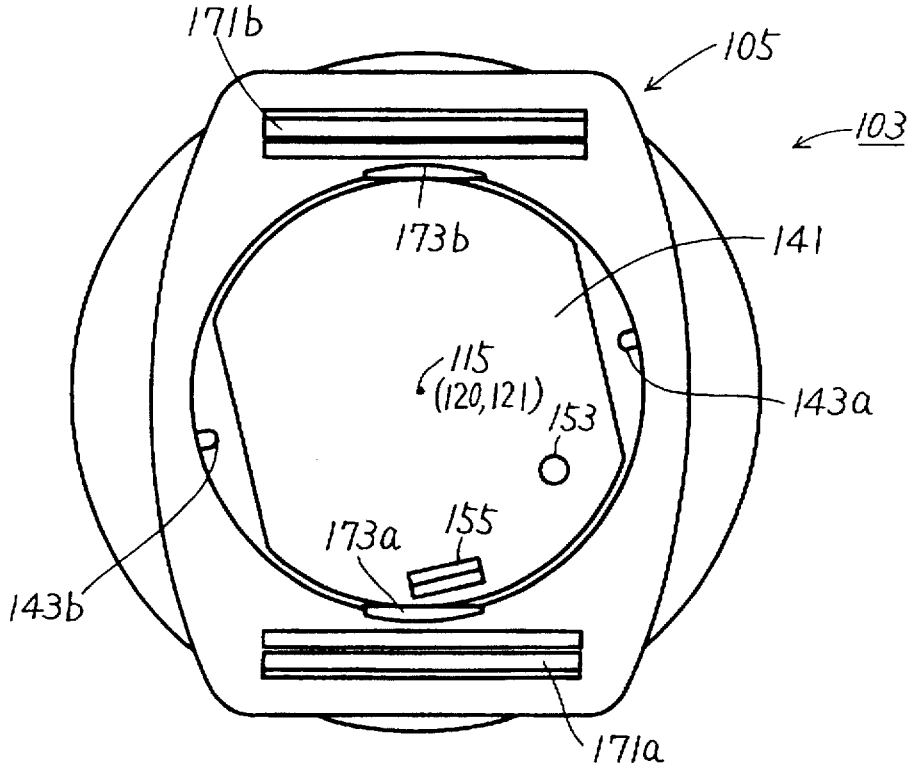
FIG. 13 is a diagram showing a state where the watch portion shown in FIG. 11 is disengaged from the recessed body.

FIG. 10 is a diagram of the recessed body, from which the band of FIG. 2 is detached, seen from the line X—X. FIG. 11 is a diagram of a state where the watch portion is attached to the recessed body of FIG. 10 seen from the rear side. FIG. 12 is a partial sectional view taken along the line XII—XII of FIG. 11. FIG. 13 is a diagram showing a state immediately after the watch portion engaged with the recessed body shown in FIG. 11 is disengaged therefrom.

Referring to FIGS. 10 to 13, recessed body 105 has openings 171*a* and 171*b* at its both ends through which a band is inserted. Recessed body 105 also has inner perimeter wall portion 117 of a shape capable of fitting in the projected body along outer perimeter wall portions 145*a*–145*d* shown in FIGS. 7 to 9. More specifically, inner perimeter wall portion 117 has a shape formed by continuously joining the circumferences of circles with their radii (diameters) orthogonal to second reference axis 121 decreasing as their centers change from the front to the back of the figure along second reference axis 121. Further, recessed body 105 has projected portions 173*a* and 173*b* which can engage with recessed portions 147*a* and 147*b* shown in FIGS. 7 and 9. Projected portions 173*a* and 173*b* are positioned opposing to each other around second reference axis 121. The length between the end surfaces of projected portions 173*a* and 173*b* is approximately equal to the length L3 shown in FIGS. 7 and 9.

When such recessed body 105 and watch portion 103 as described above are pressed from both sides, they are in an engaged state as shown in FIG. 11. More specifically, projected portion 173a of recessed body 105 engages with recessed portion 147a of projected body 141 in watch portion 103, as shown in FIG. 12. Similarly, projected portion 173b of recessed body 105 engages with recessed portion 147b of projected body 141 in watch portion 103. Further, outer perimeter wall portions 145a, 145b, 145c and 145d of projected body 141 shown in FIG. 7 are fitted in inner perimeter wall portion 117 of recessed body 105, thereby bringing watch portion 103 and recessed body 105 to a completely engaged state. In the engaged state, first reference axis 120 of projected body 141 is completely aligned with second reference axis 121 of recessed body 105 to serve as rotation axis 115. Even when outer perimeter wall portions 145a–145d of projected body 141 are not completely fitted in inner perimeter wall portion 117 of recessed body 105, if the area of the other side 137b of display function portion 135 in watch portion 103 shown in FIG. 7 is larger than the area of a shape formed by joining the upper end portions of inner perimeter wall portion 117 of recessed body 105, watch portion 103 never penetrates through a space formed by inner perimeter wall portion 117.

By relatively rotating and shifting watch portion 103 and recessed body 105 around rotation axis 115 in such an engaged state as shown in FIG. 11, projected portions 173a and 173b shown in FIG. 10 come into contact with outer perimeter wall portions 145a and 145b or outer perimeter wall portions 145c and 145d. Since the length L3 between recessed portions 173a and 173b is smaller than the length L1 shown in FIG. 7, not only watch portion 103 is disengaged from recessed body 105, but also watch portion 103 is separated from recessed body 105 as if it naturally comes up. Therefore, the user can easily detach watch portion 103 from recessed body 105. FIG. 13 shows such a state where watch portion 103 is separated.

Figure 14:
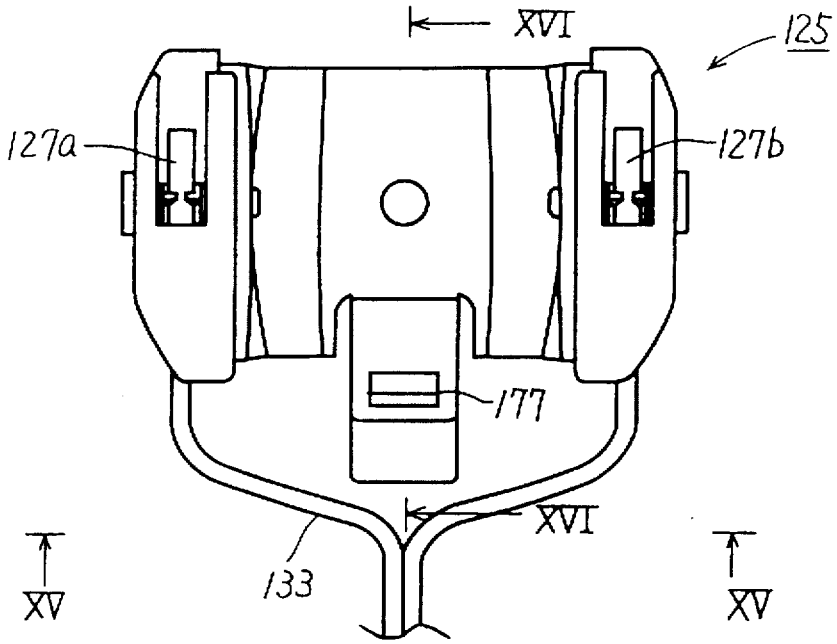
FIG. 14 is a diagram seen from the line XIV—XIV of FIG. 3.
Figure 15:
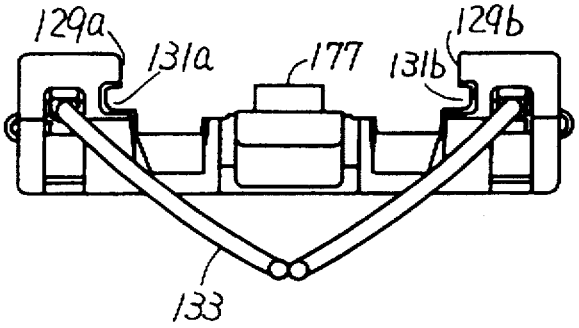
FIG. 15 is a diagram seen from the line XV—XV of FIG. 14.
Figure 16:
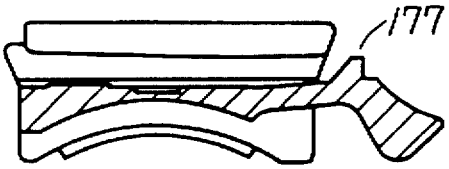
FIG. 16 is a sectional view taken along the line XVI—XVI of FIG. 14.
Figure 17:
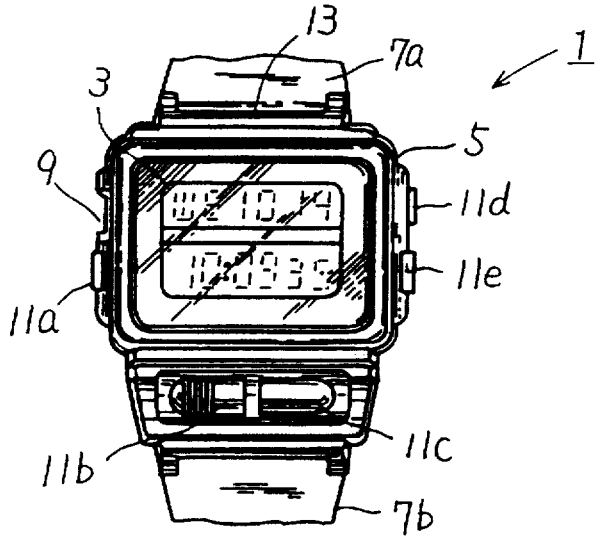
PRIOR ART FIG. 17
FIG. 17 is a diagram showing a conventional wrist watch used also as a speedometer.
Figure 18:
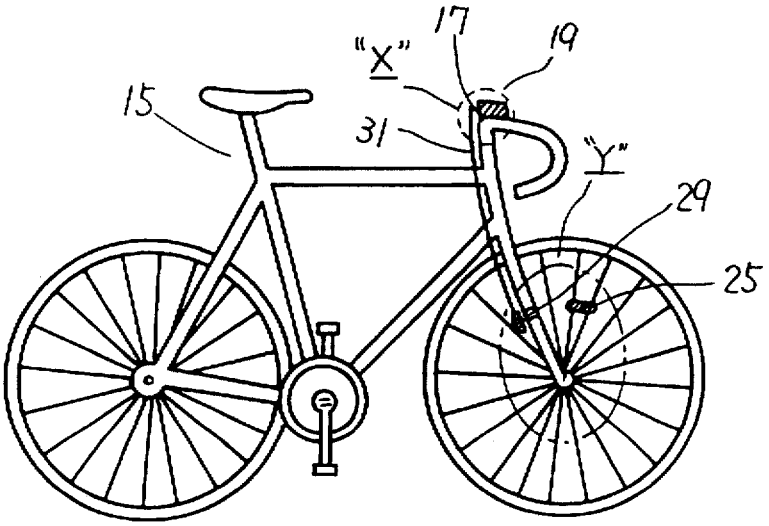
PRIOR ART FIG. 18
FIG. 18 is a side view showing a state where the wrist watch shown in FIG. 17 is attached to a bicycle as a speedometer
Figure 19:
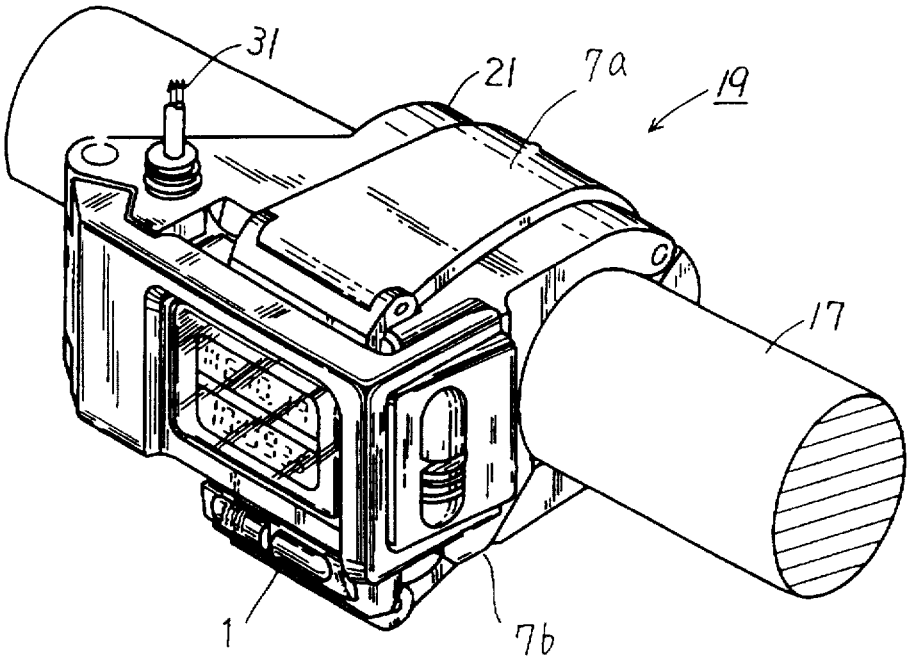
PRIOR ART FIG. 19
FIG. 19 is an enlarged perspective view of the "X" portion of FIG. 18.
Figure 20:
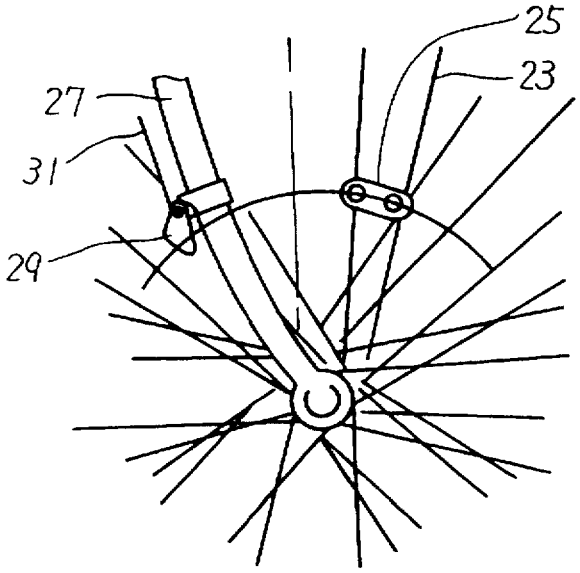
PRIOR ART FIG. 20
FIG. 20 is an enlarged view of the "Y" portion of FIG. 18.
Figure 21:
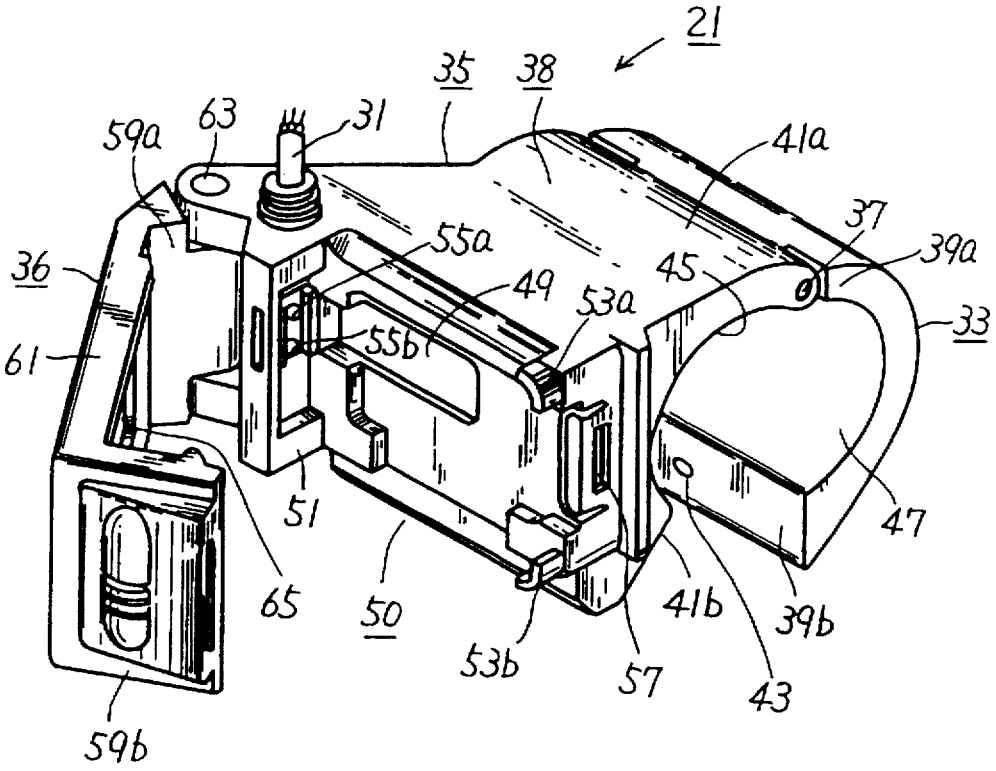
PRIOR ART FIG. 21
FIG. 21 is a diagram showing a bracket disengaged from the wrist watch and the handlebars of the bicycle shown in FIG. 19.

FIG. 14 is a diagram seen from the line XIV—XIV of FIG. 3, FIG. 15 is a diagram seen from the line XV—XV of FIG. 14, and FIG. 16 is a sectional view taken along the line XVI—XVI of FIG. 14.

Referring to FIGS. 14 to 16, description will now be given of the bracket. Further, description will be given of attachment of watch portion 103 to the bracket. Bracket 125 shown in FIG. 3 has connecting terminals 127a and 127b, slide projected portions 129a and 129b, and slide recessed portions 131a and 131b, as described above. Further, bracket 125 has projection 177 which engages with recess 155 on end surface 144 of projected body 141 in watch portion 103 shown in FIG. 7. The projection 177 is resilient in the up and down direction. When engaged, slide recessed portions 149a and 149b and slide projected portions 151a and 151b of watch portion 103 are first slided and fitted in slide projected portions 129a and 129b and slide recessed portions 131a and 131b. Finally, by recess 155 shown in FIG. 7 engaging with projection 177 of bracket 125, watch portion 103 and bracket 125 can be engaged with each other.

On the other hand, connecting terminals 143a and 143b of watch portion 103 shown in FIG. 7 are connected to connecting terminals 127a and 127b of bracket 125, respectively, to be rendered conductive. Signals through cord 133 are sent to display function portion 135 shown in FIG. 6 through connecting terminals 127a, 127b, 143a and 143b, and an operation of the signals is performed. The user visually identifies display portion 102, and recognizes a speed, a mileage or the like based on the operation.

As described above, recessed body 105 and projected body 141 in watch portion 103 are easily engaged and easily disengaged. In particular, when recessed body 105 and watch portion 103 are disengaged by relative rotation around rotation axis 115, recessed body 105 and watch portion 103 are not simply disengaged. In this case, recessed body 105 and watch portion 103 are easily separated by projected portion 173a of inner perimeter wall portion 117 in recessed body 105 coming into contact with outer perimeter wall portion 145b or outer perimeter wall portion 145d in projected body 141, and by projected body 173b of inner perimeter wall portion 117 coming into contact with outer perimeter wall portion 145a or outer perimeter wall portion 145c.

Since recessed body 105 has only to be engaged with or disengaged from projected body 141 in watch portion 103, display function portion 135 of watch portion 103 is not limited to a particular shape. A watch portion different in colors or shapes can be used as long as a recessed body is engaged with or disengaged from a projected body of the watch portion.

Since the band formed integrally with the watch portion in a conventional example can be separated from the watch portion, the material of the band need not be limited to rubber, for example. In the embodiment, since recessed body 105 can be separated from band 107, a band different in materials can be used as required.

Description was given of a projected body of watch portion 103 and a recessed body as an example of the engagement structure according to the present invention. However, watch portion 103 need not have the projected body. A watch portion may be provided on the side of a recessed body, and a band may be provided on the side of a projected body engaging the recessed body.

In the above description, projected portions 173a and 173b were provided to recessed body 105, and recessed portions 147a and 147b were provided to projected body 141 of watch portion 103. However, the present invention is not limited thereto. More specifically, the similar effects can be obtained by providing a set of projected portions to the projected body at opposite positions, and by providing recessed portions engaging therewith to the recessed body. Similarly, the similar effects can be obtained by providing a set of a projected portion and a recessed portion to the projected body at opposite positions, and by providing to the recessed body a set of a recessed portion and a projected portion engaging with the set provided to the projected body.

Further, even if either a recessed portion or projected portion is provided to the projected body, and either a corresponding projected portion or recessed portion is provided to the recessed body, engagement of the projected body and the recessed body can be implemented depending on the fitting state of the inner perimeter wall portion and the outer perimeter wall portions.

Although four outer perimeter wall portions are provided to the projected body, the number of outer perimeter wall portions may be two if the direction of relative rotation of the projected body and the recessed body is determined. When the rotation direction is determined and only one projected portion or recessed portion is provided, the number of outer perimeter wall portions may be one. In this case, the inner perimeter wall portion may be provided only at a portion fitting in the one or two outer perimeter wall portions.

Further, the projected body of this embodiment is provided with slide recessed portions and slide projected portions in order for the watch portion to be attached to the bracket. However, the projected body does not have to be provided with such slide recessed portions and slide projected portions if it may be simply detached and need not be attached to the bracket.

Although the recessed body and the band are separated in this embodiment, the recessed body may be formed integrally with the band.

The engagement structure according to the present invention which was applied to a wrist watch is not limited to application to a wrist watch. The engagement structure of the present invention can be applied to all engagement structures which need be engaged and disengaged.

Although the present invention has been described and illustrated in detail, it is clearly understood that the same is by way of illustration and example only and is not to be taken by way of limitation, the spirit and scope of the present invention being limited only by the terms of the appended claims.

What is claimed is:

1. An engagement structure adapted to detachably secure a component to a bicycle, said engagement structure being formed of a projected body including a first reference axis and a recessed body including a second reference axis, in which said projected body and said recessed body are engaged with second other with said first reference axis and said second reference axis aligned as a rotation axis and disengaged by relative rotation around said rotation axis, wherein said projected body includes an outer perimeter wall portion using as an outer surface at least a part of a surface formed by joining the circumferences of circles with their centers at said first reference axis and with their diameters orthogonal to said first reference axis and decreasing continuously as change of their center positions on said first reference axis, and a recessed portion or projected portion formed at said outer perimeter wall portion, and said recessed body includes an inner perimeter wall portion using as an inner surface at least a part of a surface formed by joining the circumferences of circles with their centers at said second reference axis and with their diameters orthogonal to said second reference axis and decreasing continuously as change of their center positions on said second reference axis, and having a shape capable of rotatably fitting in said outer perimeter will portion around said rotation axis, and a projected portion or recessed portion formed at said inner perimeter portion wall of a shape complementary to that of the recess portion or projected portion, respectively, of said outer perimeter wall portion and capable of engaging with said recessed portion or projected portion, respectively, of said outer perimeter wall portion, the projected portion or recessed portion of the projected body and the recessed body arc engaged by being pressed together and upon relative rotation, the projected portion or recessed portion of the projecting body and the recessed portion or projected portion of the recessed body are disengaged to release the projected body from the recessed body.

2. The engagement structure as recited in claim 1, wherein said outer perimeter wall portion and said inner perimeter wall portion are each provided at two opposing positions around said first reference axis and said second reference axis, respectively.

3. The engagement structure as recited in claim 2, wherein said outer perimeter wall portion includes part of a projected portion of a sidewall of a first truncated cone, and said inner perimeter wall portion includes part of a recessed portion of a sidewall of a second truncated cone.

4. The engagement structure as recited in claim 3, wherein the recessed portion formed at said outer perimeter wall portion is formed by notching part of the projected portion of the sidewall of said first truncated cone.

5. The engagement structure as recited in claim 3, wherein said projected body includes rectangular parallelepiped outer perimeter wall portions using a pair of opposing sidewalls of the rectangular parallelepiped as an outer surface.

6. The engagement structure as recited in claim 5, wherein said rectangular parallelepiped outer perimeter wall portions are each provided with a slide recessed portion which can be slidably fitted in a pair of parallel rail-shaped engagements when said projected body is moved in the direction orthogonal to said first reference axis.

7. The engagement structure as recited in claim 1, wherein said projected body is fixed to a watch portion of a wrist watch, and said recessed body receives a band of said wrist watch.

8. The engagement structure as recited in claim 7, wherein said projected body is provided with a pair of parallel slide recessed portions capable of slidably engaging the watch portion of said wrist watch with a bracket attached to a part of a said bicycle.

* * * * *

UNITED STATES PATENT AND TRADEMARK OFFICE

CERTIFICATE OF CORRECTION

PATENT NO. : 5,761,157

DATED : June 2, 1998

INVENTOR(S) : Goro Takeda and Takashi Ueda

It is certified that error appears in the above-indentified patent and that said Letters Patent is hereby corrected as shown below:

Column 9, Claim 1, line 6, change "second" to --each--.

Signed and Sealed this

Fifteenth Day of December, 1998

Bruce Lehman

*Attest:*

BRUCE LEHMAN

*Attesting Officer*

*Commissioner of Patents and Trademarks*